US006963309B2

(12) United States Patent
Andersson et al.

(10) Patent No.: US 6,963,309 B2
(45) Date of Patent: Nov. 8, 2005

(54) MULTI-BAND ANTENNA FOR USE IN A PORTABLE TELECOMMUNICATION APPARATUS

(75) Inventors: Johan Andersson, Malmö (SE); André Da Silva Frazao, Malmö (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 47 days.

(21) Appl. No.: 10/466,995

(22) PCT Filed: Dec. 14, 2001

(86) PCT No.: PCT/SE01/02769

§ 371 (c)(1),
(2), (4) Date: Sep. 22, 2003

(87) PCT Pub. No.: WO02/060006

PCT Pub. Date: Aug. 1, 2002

(65) Prior Publication Data

US 2004/0070541 A1 Apr. 15, 2004

Related U.S. Application Data

(60) Provisional application No. 60/265,471, filed on Jan. 31, 2001.

(30) Foreign Application Priority Data

Jan. 24, 2001 (SE) ..... 0100185

(51) Int. Cl.[7] ..... H01Q 1/24
(52) U.S. Cl. ..... 343/702; 343/700 MS
(58) Field of Search ..... 343/700 MS, 702, 343/846, 866, 895

(56) References Cited

U.S. PATENT DOCUMENTS

| | | | | | |
|---|---|---|---|---|---|
| 5,621,571 | A | * | 4/1997 | Bantli et al. | 359/529 |
| 5,668,557 | A | | 9/1997 | Kawahata | 343/700 MS |
| 6,028,567 | A | * | 2/2000 | Lahti | 343/895 |
| 6,124,831 | A | | 9/2000 | Rutkowski et al. | 343/700 MS |
| 6,147,649 | A | | 11/2000 | Ivrissimtzis et al. | 343/700 MS |
| 6,388,626 | B1 | * | 5/2002 | Gamalielsson et al. | 343/702 |
| 6,456,246 | B2 | * | 9/2002 | Saito | 343/702 |
| 6,509,879 | B2 | * | 1/2003 | Cassel | 343/767 |
| 6,535,172 | B2 | * | 3/2003 | Hirabayashi | 343/725 |

FOREIGN PATENT DOCUMENTS

| | | |
|---|---|---|
| DE | 198 57 819 A1 | 6/1999 |
| EP | 0 923 158 A2 | 6/1999 |
| EP | 0 986 130 A2 | 3/2000 |
| JP | 09-312516 | 12/1997 |
| JP | 10 107535 | 4/1998 |
| JP | 2001-217632 | 8/2001 |
| WO | WO 99/25043 | 5/1999 |
| WO | WO 01/80355 A1 | 10/2001 |

* cited by examiner

*Primary Examiner*—Tho Phan
(74) *Attorney, Agent, or Firm*—Jenkens & Gilchrist, P.C.

(57) ABSTRACT

A multi-band antenna for use in a portable telecommunication apparatus has a continuous trace (11) of conductive material. The continuous trace has a first conductive portion (13) arranged in a first plane and a second conductive portion (15–16) arranged in a second plane. The second plane is different from the first plane. The first conductive portion has a feeding end (12) to be connected to radio circuitry in the portable telecommunication apparatus. The second conductive portion (15–16) has a distinctly smaller width than the first conductive portion (13).

25 Claims, 11 Drawing Sheets

First embodiment

Second embodiment

Third embodiment

Fourth embodiment

Markers: 1: 2.7913
880.000 MHz
2: 1.6140
960.000 MHz
3: 2.0672
1 710.000 MHz
4: 1.2093
1 990.000 MHz
5: 1.7072
2 170.000 MHz Markers: 1: 31.082 Ω
-37.746 Ω
880.000 MHz
2: 43.023 Ω
-21.230 Ω
960.000 MHz
3: 24.721 Ω
-6.4316 Ω
1 710.000 MHz
4: 48.086 Ω
-9.1191 Ω
1 990.000 MHz
5: 44.707 Ω
-25.037 Ω
2 170.000 MHz Markers: 1: 3.1541
880.000 MHz
2: 1.4736
960.000 MHz
3: 1.2858
1 710.000 MHz
4: 1.7437
1 990.000 MHz
5: 2.3948
2 170.000 MHz Markers: 1: 20.738 Ω
-25.650 Ω
880.000 MHz
2: 34.125 Ω
0.5234 Ω
960.000 MHz
3: 40.193 Ω
5.4785 Ω
1 710.000 MHz
4: 68.477 Ω
-27.254 Ω
1 990.000 MHz
5: 43.982 Ω
-41.824 Ω
2 170.000 MHz

MULTI-BAND ANTENNA FOR USE IN A PORTABLE TELECOMMUNICATION APPARATUS

This patent application claims the benefit of priority from U.S. Provisional Patent Application Ser. No. 60/265,471 filed on Jan. 31, 2001. This application incorporates by reference the entire disclosure of U.S. Provisional No. 60/265,471.

Generally speaking, the present invention relates to antennas for portable telecommunication apparatuses, such as mobile telephones. More particularly, the invention relates to a multi-band antenna for use in a portable telecommunication apparatus and having a continuous trace of conductive material, where the continuous trace has a first conductive portion arranged in a first plane and a second conductive portion arranged in a second plane, different from the first plane.

PRIOR ART

A portable telecommunication apparatus, such as a mobile telephone, requires some form of antenna in order to establish and maintain a wireless radiolink to another unit in the telecommunications system, normally a radio base station. Some years ago, many mobile telephones were provided with retractable whip antennas or non-retractable stub or helix antennas. More recently, other antenna types have been developed, which comprise a trace of thin conductive material, usually copper, that is printed on a flexible dielectric substrate and is mounted on a suitable portion of the mobile telephone.

WO99/25043 discloses an antenna, which comprises a printed trace of conductive material to be mounted on a flip, that is pivotally mounted to the main apparatus housing of the telephone. The printed antenna trace comprises a meander-shaped portion, which acts as the actual antenna, and a spiral-shaped portion, which acts as an impedance matching network. On an opposite side of the flip a ground patch element is provided in alignment with the spiral-shaped impedance matching portion of the printed trace.

EP-A2-0 923 158 discloses a dual-band antenna of a similar type. A radiating element with a meander form is printed on a first surface of a dielectric plate. On an opposite surface of the dielectric plate there is provided a planar parasitic element, which in some embodiments may operate as a separate radiator, thereby providing the antenna with the ability of operating in three frequency ranges. The antenna of EP-A2-0 923 158 is particularly adapted for mounting on the back wall of a mobile telephone.

U.S. Pat. No. 6,124,831 discloses a folded dual frequency band antenna for a wireless communicator. A C-shaped dielectric substrate has a folded configuration. A continuous trace of conductive material, which serves as a radiating element, is disposed on first and second opposite and parallel surfaces of the dielectric substrate. Between the first and second portions of continuous trace of conductive material disposed on the two parallel surfaces of the dielectric substrate, there is provided an elongated dielectric spacer. Moreover, the first portion of the continuous trace of conductive material is electrically coupled to the second portion by an intermediate portion of conductive material, which is disposed on a third surface of the dielectric substrate, orthogonal to the first and second surfaces. The antenna provides at least two separate and distinct frequency bands. The continuous trace of conductive material, which is disposed on the first, second and the intermediate third surface of the dielectric substrate, has a uniform meander shape with identical configuration and tracewidth.

SUMMARY OF THE INVENTION

It is a primary object of the present invention to provide a substantial improvement over previously known antennas of the type having a trace of thin conductive material and being adapted to operate in more than one frequency band. More specifically, it is an object of the invention to provide an antenna, which is both small and has good performance not only in a low frequency band, such as the 900 MHz GSM band, but also good performance in several higher frequency bands, such as the 1800 MHz GSM or DCS band, the 1900 MHz GSM or PCS band, the 2.1 GHz UMTS band as well as the 2.4 GHz ISM (Bluetooth®) band.

An additional object is to provide an antenna, which may be formed as a continuous trace of conductive material without requiring a separate parasitic element for impedance matching purposes.

Still an object of the invention is to provide an antenna, which does not require a well-defined electrical ground.

Yet another object is to provide an antenna, which is inexpensive to manufacture.

Finally, another object is to provide an antenna, which may be embedded in a plastic or rubber coating, which may be attached to an external portion of the mobile telephone and which may be bent, to some extent, without damaging the antenna.

The objects above are achieved by a multi-band antenna according to the attached independent claim. More specifically, the objects are achieved for a multi-band antenna of the type comprising a continuous trace of conductive material having a first conductive portion arranged in a first plane and a second conductive portion arranged in a second plane, the first and second planes being different from each other, and the first conductive portion having a feeding end to be connected to radio circuitry in a portable telecommunication apparatus, by arranging the second conductive portion so that it has a distinctly smaller width than the first conductive portion.

According to a preferred embodiment, the above objects are moreover achieved by designing the first conductive portion as a broad rectilinear feeding strip, whereas the second conductive portion is given a meander shape with a considerably narrower width. The first and second conductive portions are interconnected through a third conductive portion, which is as narrow as the second conductive portion and extends orthogonally between the first and second conductive portions, which are disposed in parallel with each other in the first and second planes, respectively. The distinct change in width between the first conductive portion (the broad feeding strip) and the intermediate third conductive portion generates an impedance blocking, which plays an important role for the electrical performance.

Advantageously, in the preferred embodiment the first and second conductive portions (i.e. the first and second parallel planes) are displaced by at least 2 mm (equal to the length of the intermediate third conductive portion), thereby limiting parasitic effects between the first and second conductive portions. Moreover, the preferred embodiment has a fourth conductive portion, which is attached to the end of the second conductive portion (the narrow meander-shaped portion) and which is considerably wider than the second conductive portion and operates to provide capacitive loading of the antenna for tuning purposes. The first conductive portion (the broad feeding strip) has a large width, which makes it considerably broader than conventional antenna traces of conductive material. In the preferred embodiment, the width of the first conductive portion is at least 5 mm, and this includes the feeding interface to the radio circuitry of the portable telecommunication apparatus.

Other objects, features and advantages of the present invention will appear from the following detailed disclosure of preferred and alternative embodiments, from the enclosed drawings as well as from the subclaims.

It should be emphasized that the term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

Preferred and alternative embodiments of the present invention will now be described in more detail with reference to the enclosed drawings, in which.

DETAILED DISCLOSURE

Figure 1:
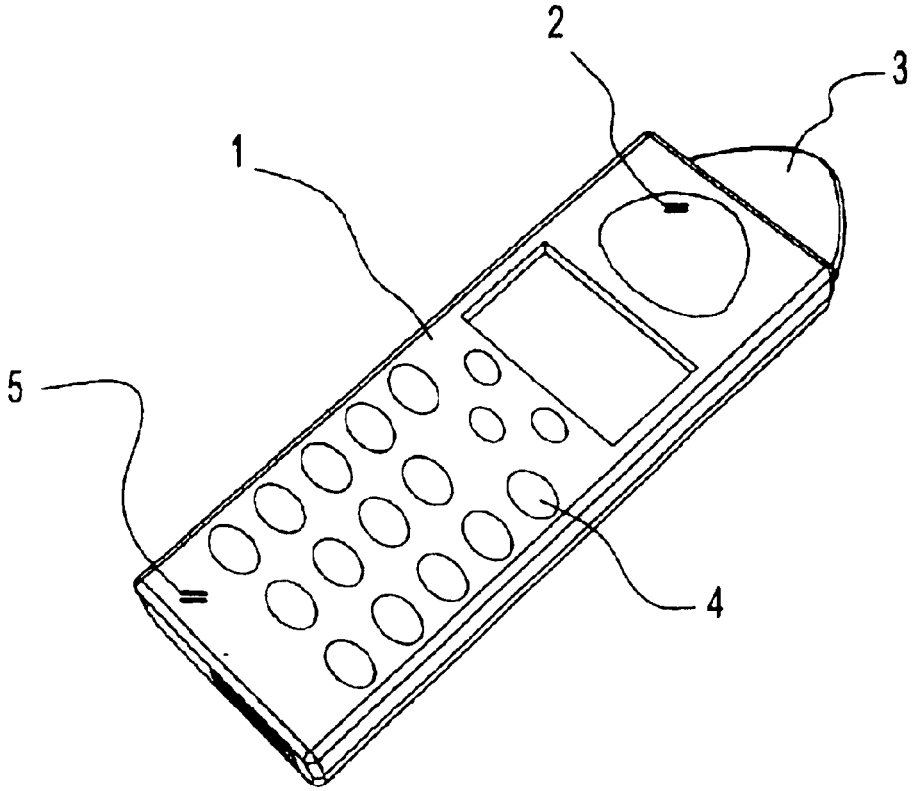
FIG. 1 is a schematic perspective view of a portable telecommunication apparatus, in the form of a mobile telephone, according to one aspect of the invention.
Figure 2:
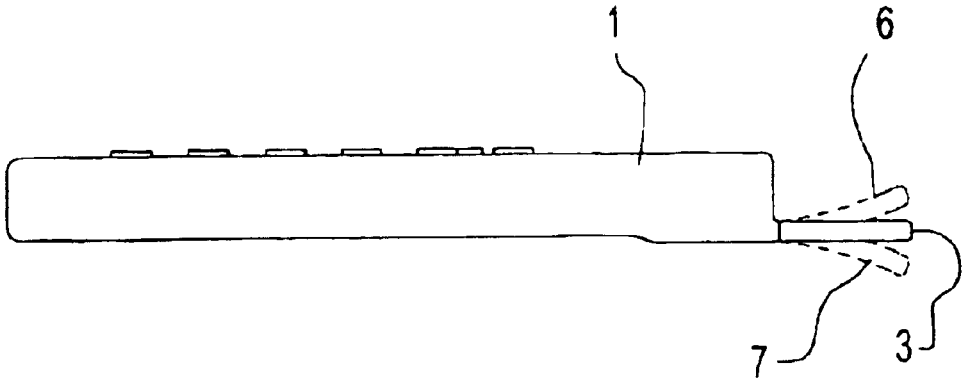
FIG. 2 is a side view of the mobile telephone shown in FIG. 1.

FIGS. 1 and 2 illustrate a mobile telephone 1 as one example of a portable telecommunication apparatus, in which the antenna according to the invention may be used. However, the inventive antenna may be used in virtually any other portable communication apparatus, which has to operate in at least two, preferably at least three, frequency bands.

The mobile telephone 1 shown in FIGS. 1 and 2 comprises a loudspeaker 2, a keypad 4, a microphone 5 and a display, as is generally known in the art. Moreover, the mobile telephone 1 comprises a plastic or rubber coating 3, which is mounted on top of the apparatus housing of the mobile telephone 1. The antenna according to the invention is embedded inside this coating, as will be further explained below. As shown particularly in FIG. 2, the plastic or rubber coating 3 has some flexibility (as indicated by reference numerals 6 and 7), so that the antenna coating 3 may be bent, to some extent, without damaging the antenna inside the coating. Obviously, this provides a great advantage as compared to conventional mobile telephones of the type having either a retractable whip antenna or a stiff helix antenna, both of which are essentially unprotected and may accidentally be broken in unfortunate situations, where the antenna is exposed to strong external bending forces.

Figure 3:
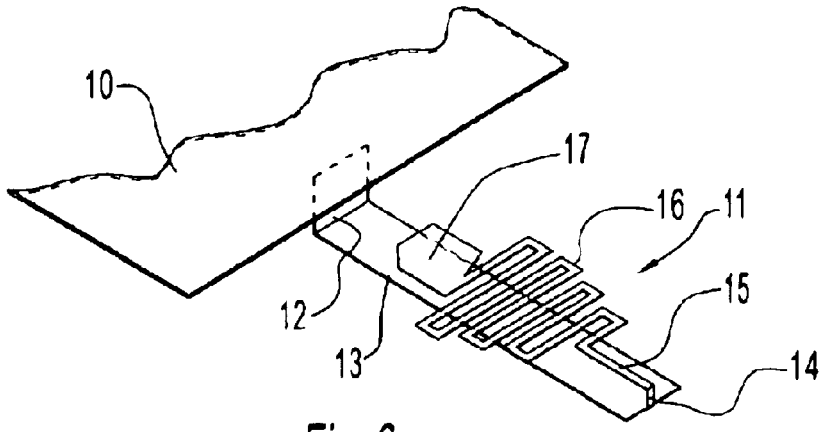
FIG. 3 is a schematic perspective view of a multi-band antenna according to a preferred (first) embodiment of the invention, connected to radio circuitry on a printed circuit board in the mobile telephone of FIGS. 1 and 2.
Figure 4:
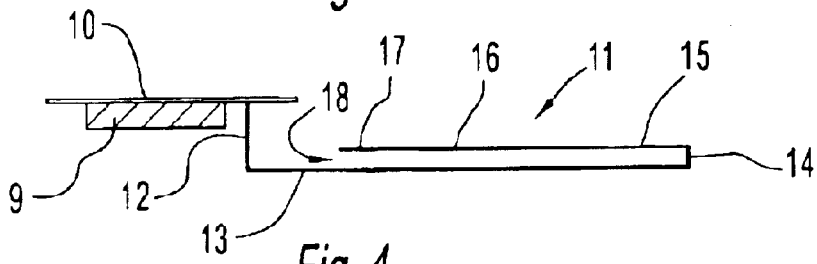
FIG. 4 is a side view corresponding to FIG. 3.
Figure 5:
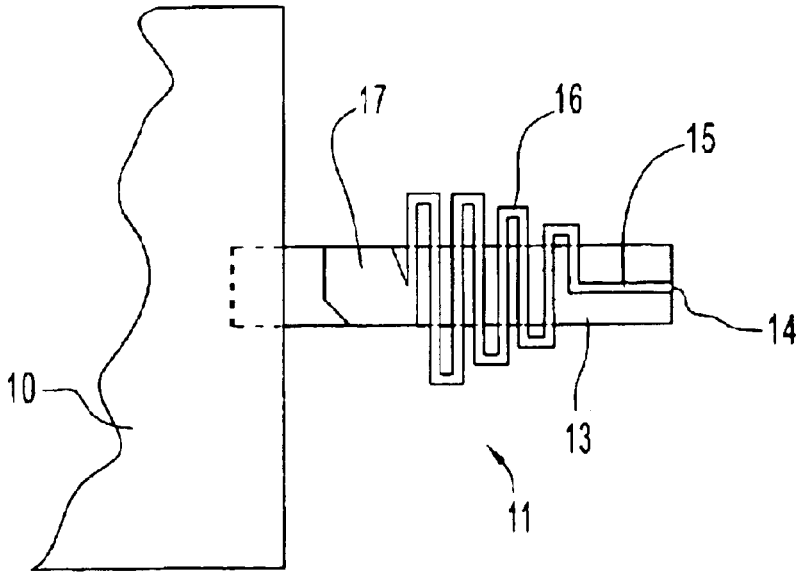
FIG. 5 is an enlarged top view of the multi-band antenna indicated in FIGS. 3 and 4, FIGS. 6, 7 and 8 illustrate a schematic perspective view, a side view and an enlarged top view of a second embodiment of the present invention.

FIGS. 3–5 illustrate a multi-band antenna 11 according to a preferred (first) embodiment of the invention. The antenna 11 consists of a continuous trace of electrically conductive material, preferably copper or another suitable metal with very good conductive properties. The conductive material is very thin, preferably about 30–35 $\mu$m; consequently the thickness of the antenna 11 has been highly exaggerated in the drawings for illustrating purposes only. As shown in FIGS. 3–5, an antenna connector 12 serves to connect the antenna 11 to radio circuitry 9 provided on a printed circuit board 10 in the mobile telephone 1. The antenna connector 12 is only schematically indicated in FIGS. 3–5. It may be implemented by any of a plurality of commercially available antenna connectors, such as a leaf-spring connector or a pogo-pin connector.

Moreover, the radio circuitry 9 as such forms no essential part of the present invention and is therefore not described in more detail herein. As will be readily realized by a man skilled in the art, the radio circuitry 9 will comprise various known HF (high frequency) and baseband components suitable for receiving a radio frequency (HF) signal, filtering the received signal, demodulating the received signal into a baseband signal, filtering the baseband signal further, converting the baseband signal to digital form, applying digital signal processing to the digitalized baseband signal (including channel and speech decoding), etc. Conversely, the HF and baseband components of the radio circuitry 9 will be capable of applying speech and channel encoding to a signal to be transmitted, modulating it onto a carrier wave signal, supplying the resulting HF signal to the antenna 11, etc.

In essence, the antenna trace 11 forms a biplanar structure (a first plane 13 and a second plane 15, 16, 17), which is arranged at a vertical distance of the order of 5–10 mm with respect to the printed circuit board 10. The planes of the antenna trace 11 may either be parallel to the printed circuit board 10, as shown in the drawings, or alternatively be arranged at an angle, such as 15°, to the printed circuit board 10, depending on the actual implementation, the design of the coating 3 with respect to the apparatus housing of the mobile telephone 1, etc. Moreover, the first and second antenna planes are preferably, but not necessarily, parallel to each other.

The antenna trace 11 comprises a first conductive portion 13, which acts as a geometrically broad feeding strip and is consequently adapted to communicate electrically with the radio circuitry 9 on the printed circuit board 10 through the antenna connector 12. The first conductive portion 13 has a rectilinear extension, as shown in the FIGS. 3–5, and it has a considerable width of several mm, preferably 5–7 mm. However, the exact value of the width of the first conductive portion 13 must be chosen under due consideration of various design and tuning parameters, as is readily realized by a man skilled in the art. The first conductive portion 13 (the broad feeding strip) will primarily act as radiator for higher frequency bands, such as DCS, PCS, UMTS or Bluetooth®, as will be described in more detail later.

A second conductive portion 15, 16 of the continuous antenna trace 11 will primarily act as radiator for a low frequency band, such as GSM 900. As shown in FIGS. 3–5, the second conductive portion 15, 16 is twisted in a meander shape (with the exception of a short initial straight part 15) and has a considerably smaller (narrower) width than the first conductive portion 13—a factor 1:10 is a suitable example.

The first conductive portion 13 is disposed in a first horizontal plane, whereas the second conductive portion 15, 16 is disposed in a second horizontal plane, and the first and second conductive portions are interconnected through a short, intermediate, third conductive portion 14, which extends orthogonally to the first and second planes, i.e. in a vertical direction between a second end of the first conductive portion 13 (opposite its feeding end adjacent to the antenna connector 12) and a first end of the second conductive portion 15, 16. The length of the third conductive portion 14 is preferably at least 2 mm; in other words the first plane including the first conductive portion 13 is separated from the second plane including the second conductive portion 15, 16 by at least 2 mm. The third conductive portion 14 is considerably narrower than the broad first conductive portion 13. Preferably, the second and third conductive portions 14 and 15, 16, respectively, have equal width.

The idea of the second conductive portion 15, 16 is to twist it fairly close to the first conductive portion 13 in order not to occupy any unnecessary space in the second plane. There will be a certain electromagnetic coupling between the first and second conductive portions 13 and 15, 16, respectively. Therefore, the exact twisting of the meander-shaped second conductive portion 15, 16 must be thoroughly tested depending on actual application. The second meander-shaped conductive portion 15, 16 is not to be confused with a traditional parasitic element, which would be placed 0.5–1 mm apart from the first conductive portion 13 without any electrical interconnection. On the contrary, through the short, vertical, third conductive portion 14 the meander-shaped second conductive portion 15, 16 is galvanically connected to the first conductive portion 13 and therefore is an actual part of the continuous antenna trace 11.

The distinct change in width between the first conductive portion 13 and the third conductive portion 14/second conductive portion 15, 16 is electrically important, since it will provide an impedance blocking that will allow multi-band operation in several broad individual frequency bands.

Optionally, a fourth conductive portion 17 may be provided as a topload at the second end of the meander-shaped second conductive portion 15, 16. The topload 17 in the preferred embodiment has an almost square-like area, which is considerably wider than the thin meander-shaped second conductive portion 15, 16. Preferably, if a topload is used, it is arranged in the same plane (i.e., the second plane) as the meander-shaped second conductive portion 15, 16. The purpose of the topload 17 is to provide capacitive loading of the continuous antenna trace 11 for tuning purposes.

A typical electrical length of the entire antenna 11, when radiating at GSM 900 MHz, will be $2\lambda/5$, where $\lambda$ is the wavelength in free space (33.3 cm). Consequently, the typical electrical length of the antenna 11 in the 1800 MHz frequency band will be approximately $\lambda/5$.

To further reduce the size of the antenna 11, a dielectric element may be inserted between the first and second planes, i.e. between the broad, straight, first conductive portion 13 and the thin, meander-shaped, second conductive portion 15, 16. For clarity reasons, such a dielectric material is only indicated by an arrow 18 in FIG. 4. In essence, the skilled person is free to choose 15 among a plurality of commercially available dielectric materials for this purpose.

A dielectric insert element 18 between the first and second conductive portions 13 and 15, 16 will have an additional benefit in that it will provide stiffness to the antenna 11 and help preventing the first and second conductive portions to be dislocated from each other. Therefore, the dielectric insert element 18 may advantageously be chosen to have a rather high stability, albeit not completely rigid in order to allow some flexibility to the encapsulated antenna 3, as indicated at positions 6 and 7 in FIG. 2.

The antenna trace 11 is attached to a flat support element, preferably in the form of a dielectric kapton (polyimide) film. In the preferred embodiment, a kapton film referred to as R/Flex 2005K is used, having a thickness of 75 $\mu$m and being commercially available from Rogers Corporation, Circuit Materials Division, 100 N, Dobson Road, Chandler, AZ-85224, USA. Alternatively, a similar dielectric film may be used, for instance provided by Freudenberg, Mectec GmbH & KG, Headquarters, D-69465 Weinheim/Bergstrasse, or any other suitable commercially available dielectric film.

The trace 11 of conductive material and the kapton film together form a flex film.

Preferably, in order to protect the continuous antenna trace 11, it is encapsulated in a rubber or plastic coating 3. DRYFLEX 502670 SEBS 67 Shore A from Nolato Elastoteknik AB, Box 51, SE-662 22 ÅMÅL, Sweden, is one example of an appropriate coating material. A suitable coating thickness may for instance be about 1–2 mm.

The first embodiment disclosed in FIGS. 3–5 is a small and efficient antenna, which provides good resonance performance in several different frequency bands. This is illustrated by a Smith diagram in FIG. 16 and a return loss diagram in FIG. 15. Both of these diagrams are the results of simulations rather than measurements made on a real antenna. A computer simulation program called IE3D, distributed by Zeland Software Inc., USA, has been used for the simulations. The simulations have been made without any rubber or plastic coating to protect the continuous antenna trace 11. Moreover, not a complete mobile telephone but only a rectangular printed circuit board 10, no real antenna connector 12 and no dielectric material 18 have been used. Therefore, particularly as regards the return loss diagram of FIG. 15, the resonance frequency ranges thereof do not correspond exactly to the desired frequency ranges in real applications. Thus, the simulated antenna exhibits optimum resonance for frequencies that are located at slightly higher frequencies than the desired frequency bands, which are: EGSM at 880–960 MHz, DCS at 1710–1880 MHz, PCS at 1850–1990 MHz, UMTS at 1920–2170 MHz and ISM/Bluetooth® at 2400–2500 MHz. The reason for this is to compensate for losses introduced by a rubber or plastic coating such as DRYFLEX. The coating will lower the resonance frequencies and also introduce some losses, which unfortunately will reduce the antenna gain slightly but which on the other hand will provide even more bandwidth.

Figure 15:
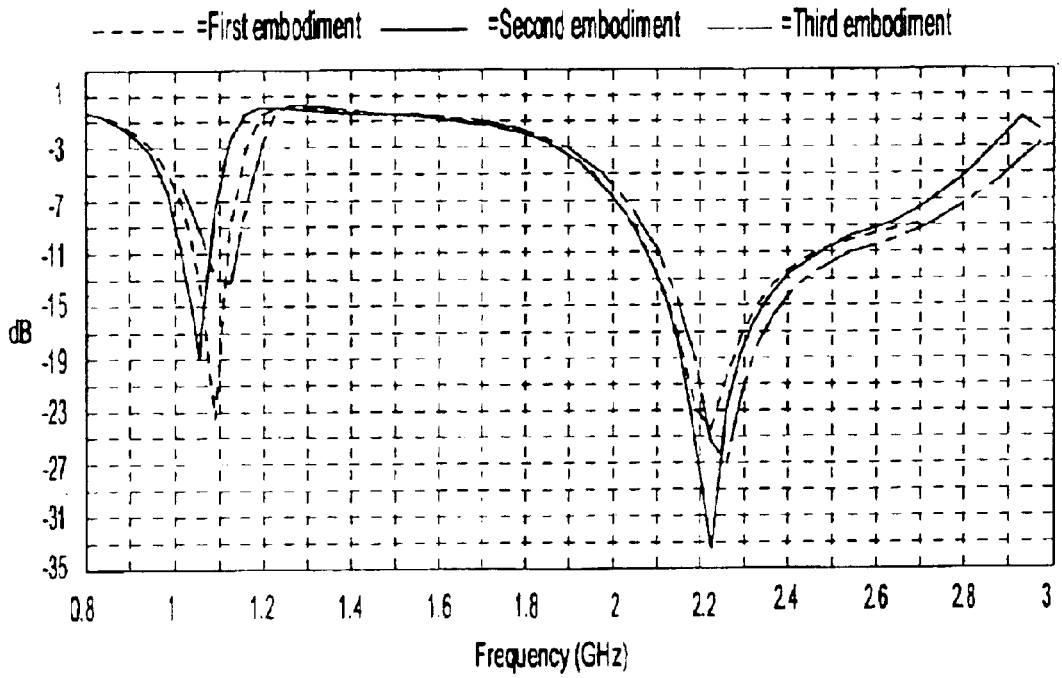
FIG. 15 is a return loss diagram to illustrate simulated performance for the first, second and third embodiments.
Figure 16:
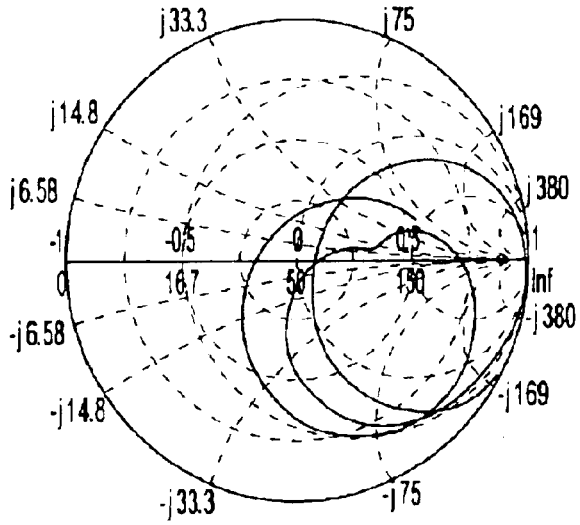
FIG. 16 is a Smith diagram representing simulated performance for the first embodiment.

As is well known to a man skilled in the art, a return loss diagram illustrates the frequencies at which an antenna is working, i.e. where the antenna is resonating. The return loss diagram presented in FIG. 15 represents the return loss in dB as a function of frequency. The lower dB values in a return loss diagram, the better. Moreover, the broader resonance, the better. In a return loss diagram, a resonance is an area, within which the return loss is low (a high negative value in dB). In the diagram of FIG. 15, this looks like a steep and deep cavity. Return loss is a parameter indicating how much energy the antenna will reflect or accept at a given frequency.

Return loss (RL) may be defined as:

$$RL=-20\cdot lg[abs(\Gamma)],$$

where $$\Gamma=(\text{reflected voltage or current})/(\text{incident voltage or current}).$$

A similar type of diagram is SWR (Standing Wave Ratio). SWR is defined as the ratio between maximum voltage or current and minimum voltage or current.

Smith diagrams are a familiar tool within the art and are thoroughly described in the literature, for instance in chapters 2.2 and 2.3 of "Microwave Transistor Amplifiers, Analysis and Design", by Guillermo Gonzales, Ph.D., Prentice-Hall, Inc., Englewood Cliffs, N.J. 07632, USA, ISBN 0-13-581646-7. Reference is also made to "Antenna Theory—Analysis and Design", Balanis Constantine, John Wiley & Sons Inc., ISBN 0471606391, pages 43–46, 57–59. Both of these books are fully incorporated in herein by reference. Therefore, the nature of Smith diagrams are not penetrated in any detail herein. However, briefly speaking, the Smith diagrams in this specification illustrate the input impedance of the antenna: Z=R+jX, where R represents the resistance and X represents the reactance. If the reactance X>0, it is referred to as inductance, otherwise capacitance.

In the Smith diagram the curved graph represents different frequencies in an increasing sequence. The horizontal axis of the diagram represents pure resistance (no reactance). Of particular importance is the point at 50 Ω, which normally represents an ideal input impedance. The upper hemisphere of the Smith diagram is referred to as the inductive hemisphere. Correspondingly, the lower hemisphere is referred to as the capacitive hemisphere.

Figure 6:
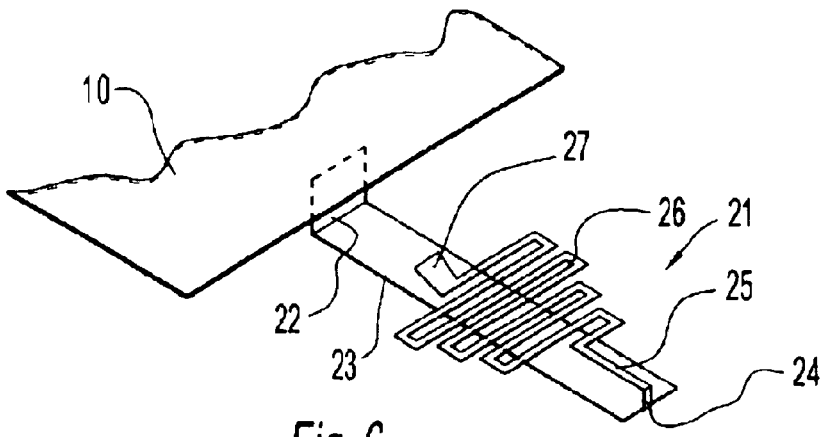
Figure 7:
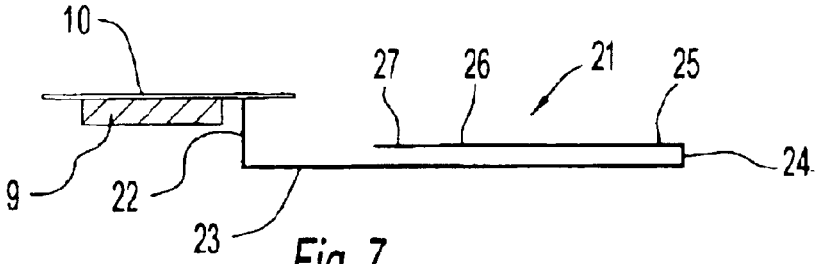
Figure 8:
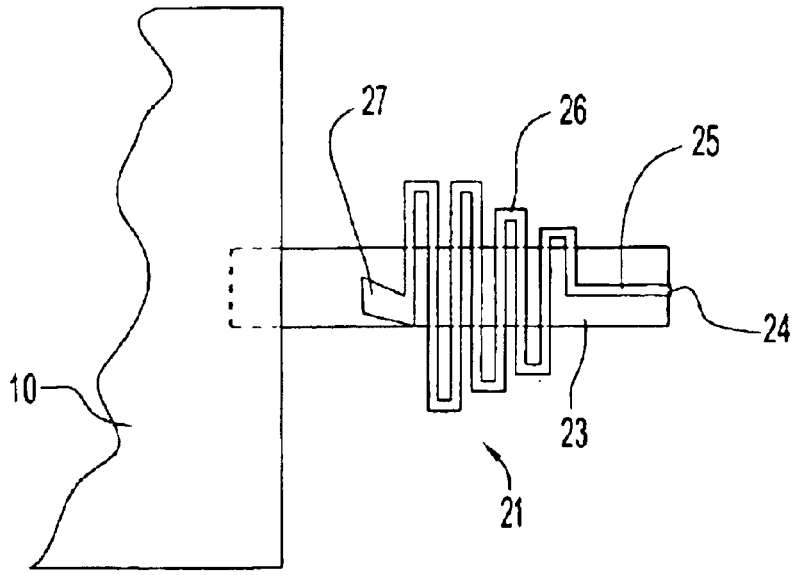
Figure 17:
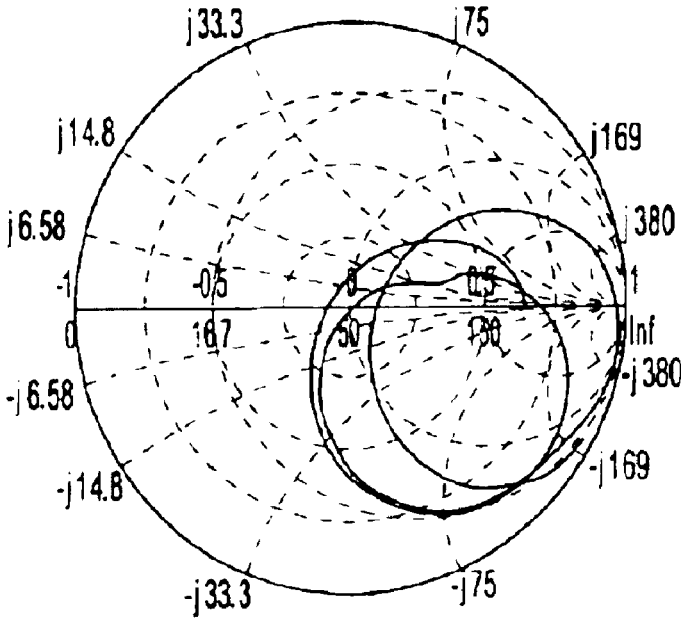
FIG. 17 is a Smith diagram representing simulated performance for the second embodiment.

A second embodiment of the antenna 21 according to the invention is disclosed in FIGS. 6–8. Like numerals in FIGS. 6–8 denote like components in FIGS. 3–5. Consequently, the antenna connector 22 of FIGS. 6–8 is essentially identical to the antenna connector 12 of FIGS. 3–5, the first conductive portion 23 of FIGS. 6–8 is essentially identical to the first conductive portion 13 of FIGS. 3–5, etc. In essence, the main difference between the first and second embodiments is the layout of the optional capacity topload 17/27, which is considerably smaller in the second embodiment than in the first embodiment. Simulated performance for the second embodiment is illustrated in the return loss diagram in FIG. 15 and in a Smith diagram in FIG. 17.

Figure 9:
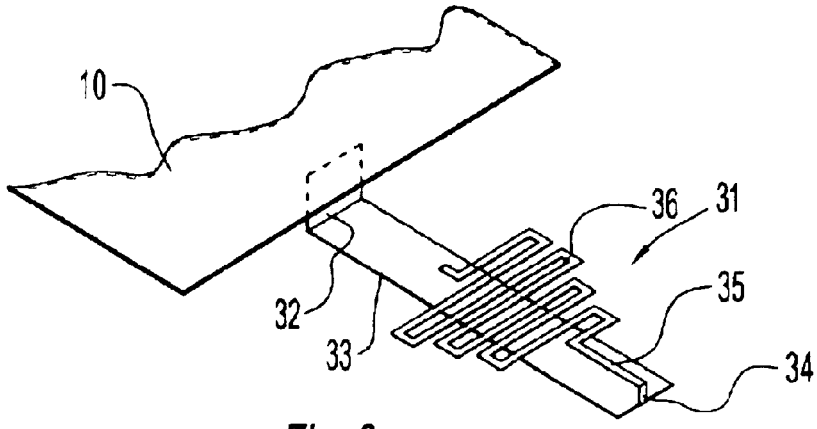
FIGS. 9–11 illustrate a schematic perspective view, a side view and an enlarged top view of a third embodiment of the present invention.
Figure 10:
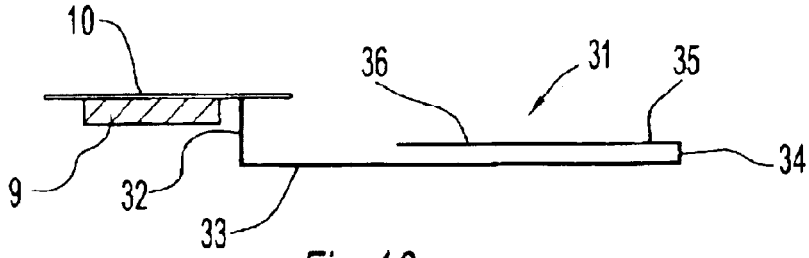
Figure 11:
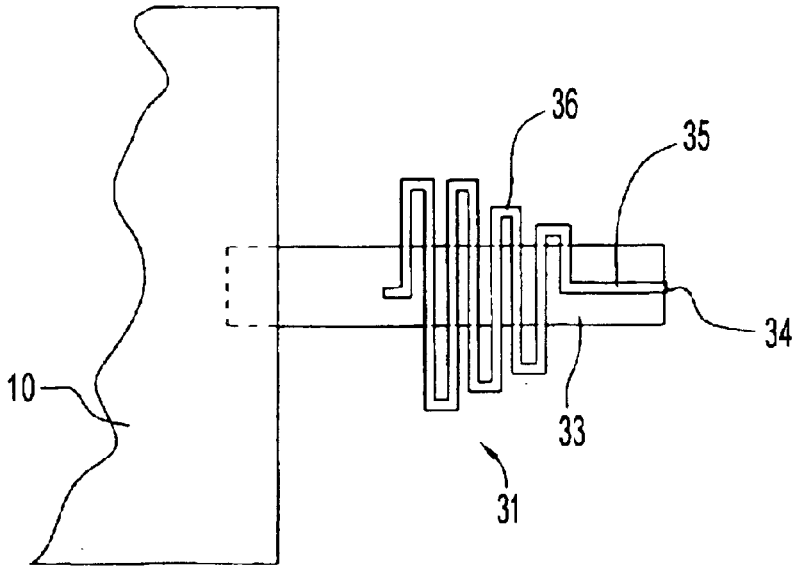
Figure 18:
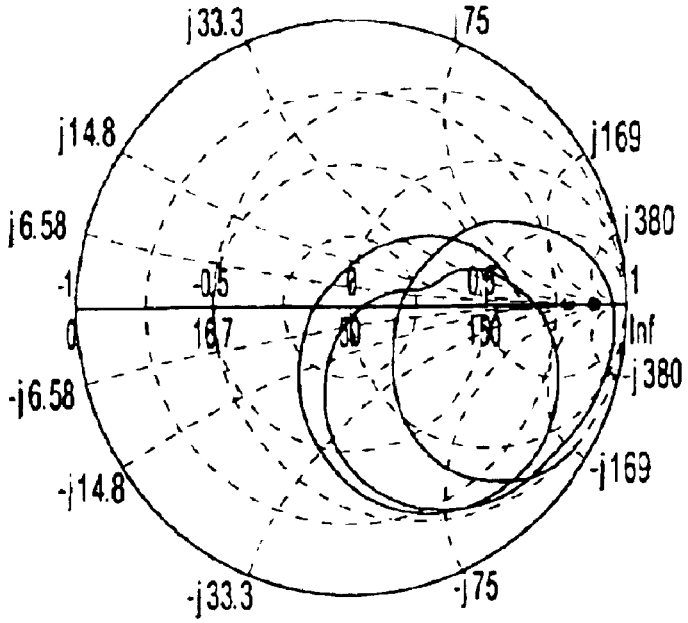
FIG. 18 is a Smith diagram representing simulated performance for the third embodiment.
Figure 19:
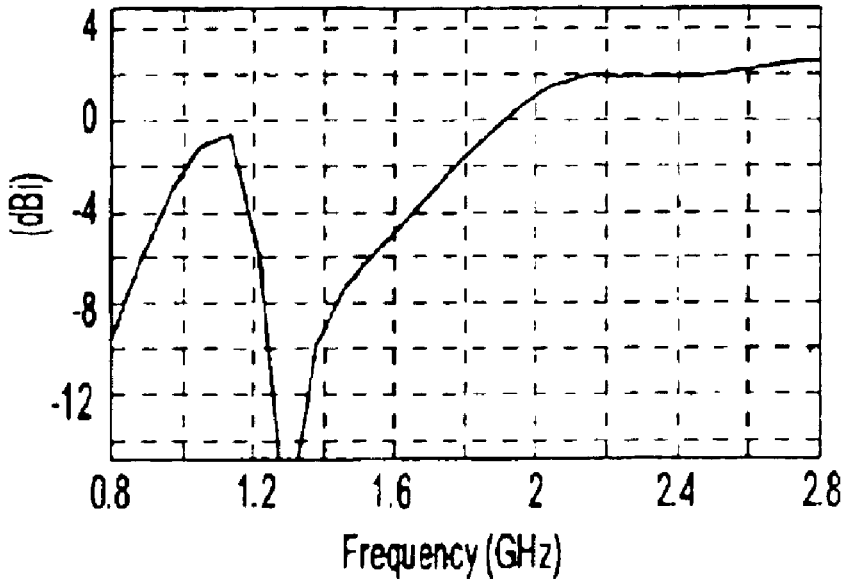
FIG. 19 illustrates circular polarization gain versus frequency for the third embodiment.
Figure 20:
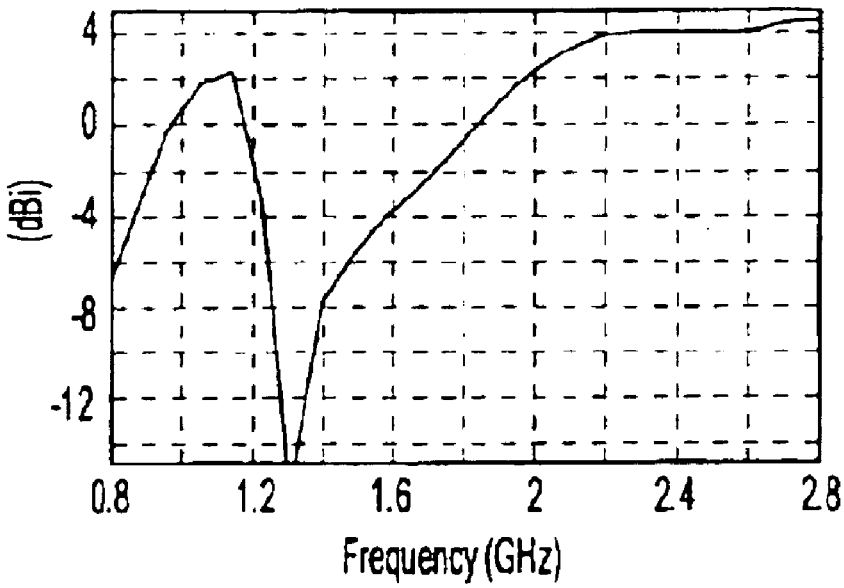
FIG. 20 illustrates linear polarization gain versus frequency for the third embodiment.
Figure 21:
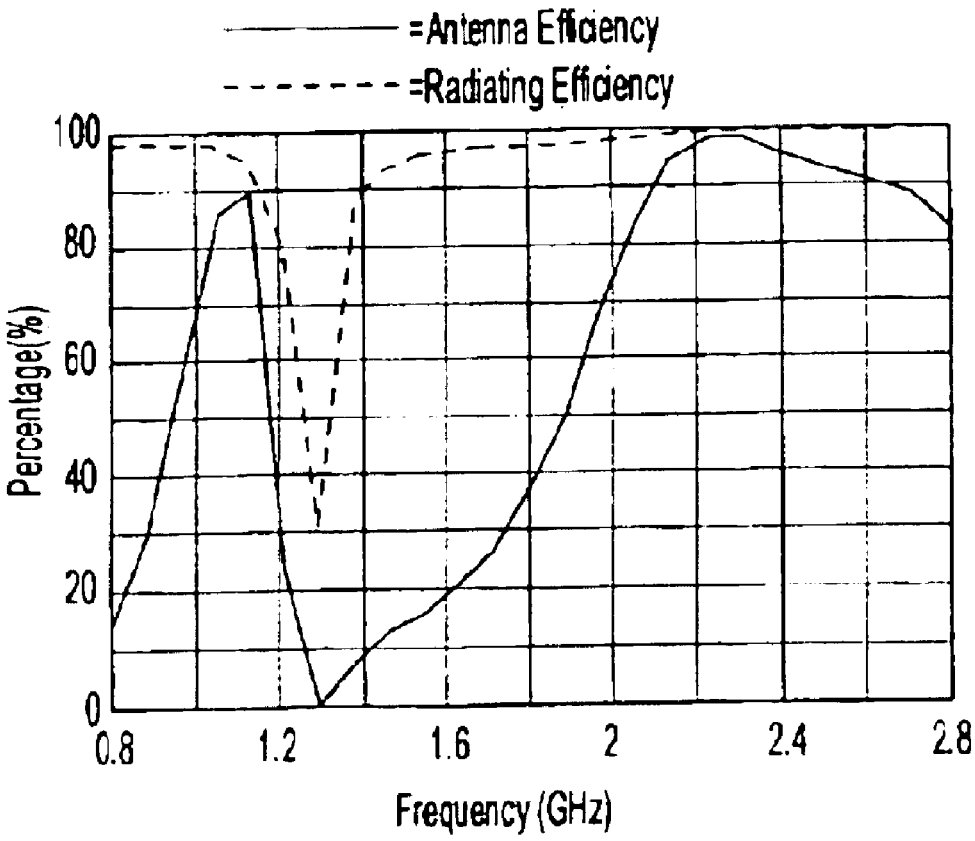
FIG. 21 illustrates antenna efficiency and radiating efficiency for the third embodiment.

A third embodiment of the antenna 31 according to the invention is disclosed in FIGS. 9–11. Like numerals in FIGS. 9–11 denote like components in FIGS. 3–5. Consequently, the antenna connector 32 of FIGS. 9–11 is essentially identical to the antenna connector 12 of FIGS. 3–5, the first conductive portion 33 of FIGS. 9–11 is essentially identical to the first conductive portion 13 of FIGS. 3–5, etc. In essence, the main difference between the third embodiment and the first embodiment is that the third embodiment does not have any capacitive topload. Simulated performance for the third embodiment is illustrated in the return loss diagram in FIG. 15 and in a Smith diagram in FIG. 18. Moreover, FIG. 19 illustrates circular polarization gain versus frequency for the third embodiment, whereas FIG. 20 illustrates linear polarization gain versus frequency, and FIG. 21 illustrates antenna efficiency and radiating efficiency. These drawings all represent simulated data.

All in all, the first, second and third embodiments are similar in design and performance.

Figure 12:
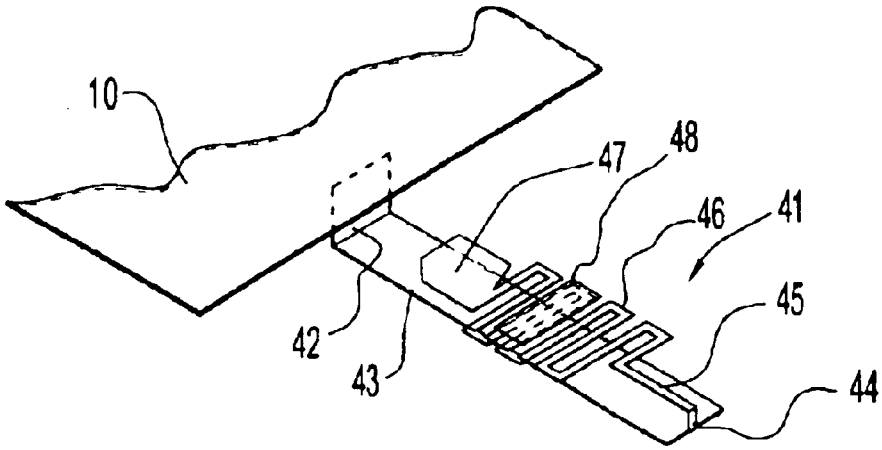
FIGS. 12–14 illustrate a schematic perspective view, a side view and an enlarged top view of a fourth embodiment of the present invention, based on practical tests.
Figure 13:
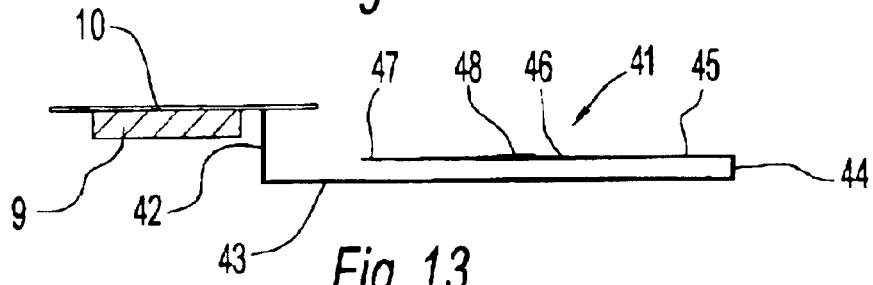
Figure 14:
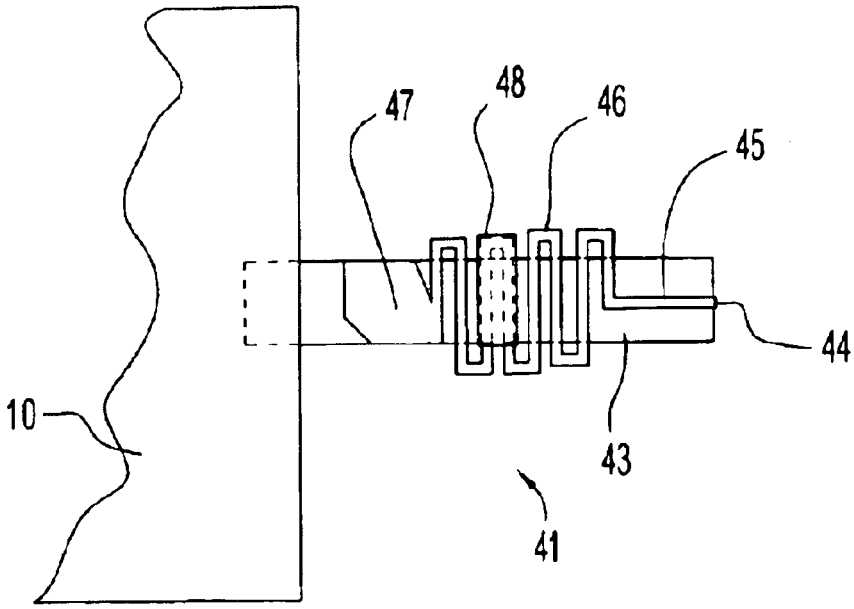
Figure 22:
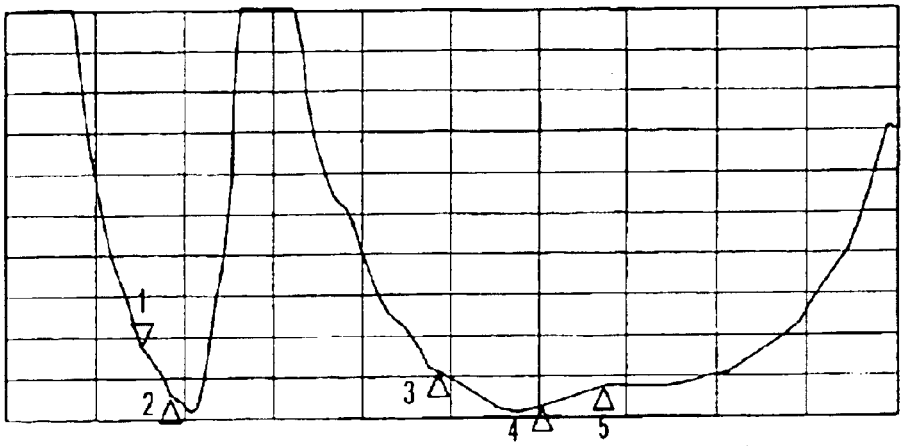
FIG. 22 is a voltage standing wave ratio (VSWR) diagram representing measured antenna performance for the fourth embodiment, when the antenna has a rubber coating and is kept in free space.
Figure 23:
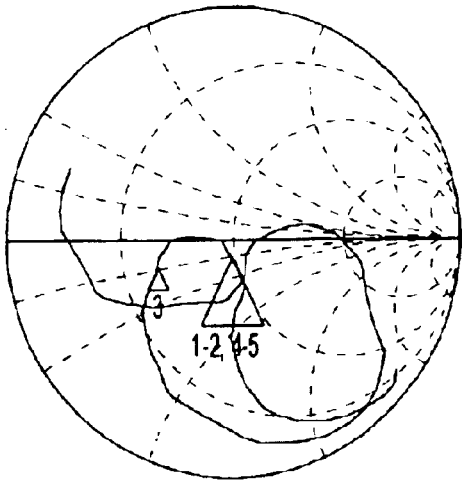
FIG. 23 is a Smith diagram which illustrates measured antenna performance for the fourth embodiment, when the antenna has a rubber coating and is kept in free space.
Figure 24:
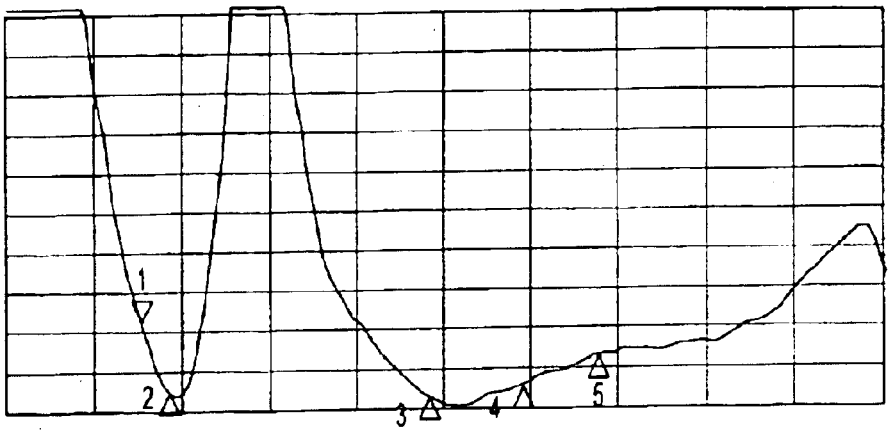
FIG. 24 is a voltage standing wave ratio (VSWR) diagram representing measured antenna performance for the fourth embodiment, when the antenna has a rubber coating and is kept in a talking position.
Figure 25:
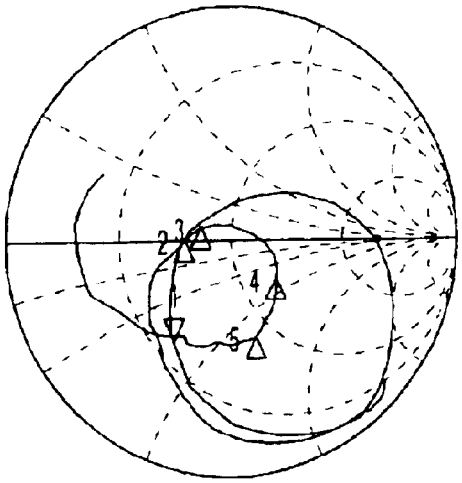
FIG. 25 is a Smith diagram which illustrates measured antenna performance for the fourth embodiment, when the antenna has a rubber coating and is kept in a talking position.

A fourth embodiment of the antenna 41 according to the present invention is illustrated in FIGS. 12–14. Compared to the previous embodiments, the fourth embodiment 41 has a difference in that its meander-shaped second conductive portion 45, 46 has a slightly different layout. Moreover, a small copper plate 48 has been attached to a portion of the meander-shaped second conductive portion 45, 46. More specifically, the copper plate 48 is positioned to provide a short circuit between two adjacent turns of the meander 46. This will displace the resonant frequencies and allow tuning to desired frequency bands. Real measurements, in contrast to simulated performance, have been made for the fourth embodiment of FIGS. 12–14. FIG. 22 illustrates an SWR diagram for the fourth embodiment, when kept in free space. FIG. 23 illustrates a corresponding Smith diagram. In the diagrams of FIGS. 22 and 23, the values at five different frequencies are indicated as markers 1–5. Conversely, FIGS. 24 and 25 illustrate measured antenna performance for the fourth embodiment, when kept in a talking position.

The antenna according to the fourth embodiment exhibits excellent performance in a lower frequency band located at the EGSM band between 880 and 960 MHz.

Moreover, the SWR diagram exhibits a very broad resonance cavity in higher frequency bands, covering important frequency bands at 1800 and 1900 MHz, as well as, in fact, even frequency bands at 2.1 GHz and 2.4 GHz.

Conclusively, not only does the antenna according to the invention provide excellent performance in a low frequency band around 900 MHz (e.g. for EGSM) but also in four different high frequency bands around 1800 MHz (e.g. DCS or GSM 1800 at 1710–1880 MHz), 1900 MHz (e.g. PCS or GSM 1900 at 1850–1990 MHz), 2100 MHz (e.g. UMTS, "Universal Mobile Telephone System") and 2400–2500 MHz (e.g. Bluetooth®, ISM—"Industrial, Scientific and Medical"). In other words, the inventive antenna is a multiband antenna with a very broad high frequency band coverage, which will be referred to further below.

Studies and experiments have proven that, above all, the geometrically broad first conductive portion 13/23/33/43 generates the broad high-band resonance indicated in the diagrams. A standing wave is obtained with a high impedance around the second end (opposite the feeding end 12) of the first conductive portion (feeding strip) 13. Conversely, above all, the meander-shaped second conductive portion

15, 16 provides good performance for the low frequency band. Moreover, the twisting of the second conductive portion 15, 16 adds inductive impedance to the antenna structure 11. This provides an impedance transformation in that the narrow twisted second conductive portion 15, 16 is considered, at high frequencies, to be of a very high impedance but of a desired low impedance, around 50 Ω, in the low frequency band. Therefore, the connection 14 between the broad feeding strip 13 and the narrow twisted portion 15, 16 operates as a kind of impedance transformer.

Additionally, it has been discovered that the bandwidth of the high frequency band(s) can be controlled by the width of the first conductive portion (broad feeding strip) 13. The bandwidth of the high frequency band(s) increases with increasing width of the first conductive portion 13, up to a certain limit.

An important aspect of the antenna according to the invention is that it does not need a well-defined electrical ground in contrast to some prior art antennas.

Another important advantage of the present invention is that it allows a very low manufacturing cost. Yet other important advantages are that it allows reduced antenna size compared to previously known solutions, and that it is self-matched to the desired impedance (e.g. 50 Ω).

The present invention has been described above with reference to a preferred embodiment together with three alternatives. However, many other embodiments not disclosed herein are equally possible within the scope of the invention, as defined by the appended independent patent claims. Particularly as regards the geometrical dimensioning of the trace of conductive material, which makes up the antenna, the various dimensions will all have to be carefully selected depending on the actual application. Moreover, the frequency bands in which the antenna is operative may also be greatly varied depending on actual application. Therefore, the antenna trace has to be tuned for the actual application, which, however, is believed to be nothing but mere routine activity for a skilled person and which therefore does not require any further explanations herein.

Even if the first conductive portion (the broad feeding strip) at least presently is preferred to have a rectilinear (straight) extension, it may be possible, in other embodiments, to design the first conductive portion in a curved form.

What is claimed is:

1. A multi-band antenna for use in a portable telecommunication apparatus, the antenna comprising a continuous trace of conductive material, the continuous trace having a first conductive portion arranged in a first plane and a second conductive portion arranged in a second plane, the second plane being different from the first plane, the first conductive portion having a feeding end to be connected to radio circuitry in the portable telecommunication apparatus, characterized in that the second conductive portion has a distinctly smaller width than the first conductive portion;

wherein the first conductive portion has a rectilinear extension, whereas the second conductive portion is meander-shaped;

wherein the first plane is parallel to the second plane and wherein the continuous trace has a third conductive portion, which interconnects the first conductive portion with the second conductive portion and which is nonparallel to the first and second planes;

wherein the third conductive portion has a width which is essentially equal to the width of the second conductive portion; and wherein the third conductive portion is connected between a second end of the first conductive portion, opposite its feeding end, and a first end of the second conductive portion, and wherein the third conductive portion extends orthogonally between the first and second planes.

2. The multi-band antenna according to claim 1, wherein the distance between the first and second planes is at least 2 mm.

3. The multi-band antenna according to claim 1, wherein the width of the first conductive portion is at least 5 mm.

4. The multi-band antenna according to claim 1, wherein the first conductive portion has a curved form.

5. The multi-band antenna according to claim 1, wherein the continuous trace has a thickness of about 30–35 μm.

6. The multi-band antenna according to claim 5, wherein the continuous trace is provided on a flexible dielectric support element.

7. The multi-band antenna according to claim 6, wherein the flexible dielectric support element is a kapton film.

8. The multi-band antenna according to claim 6 or 7, wherein the trace of conductive material and the flat dielectric support element form a flex film.

9. The multi-band antenna according to claim 1, wherein the conductive material of the continuous trace is copper.

10. A multi-band antenna for use in a portable telecommunication apparatus, the antenna comprising a continuous trace of conductive material, the continuous trace having a first conductive portion arranged in a first plane and a second conductive portion arranged in a second plane, the second plane being different from the first plane, the first conductive portion having a feeding end to be connected to radio circuitry in the portable telecommunication apparatus, characterized in that the second conductive portion has a distinctly smaller width than the first conductive portion;

wherein the first conductive portion has a rectilinear extension, whereas the second conductive portion is meander-shaped;

wherein the first plane is parallel to the second plane and wherein the continuous trace has a third conductive portion, which interconnects the first conductive portion with the second conductive portion and which is nonparallel to the first and second planes;

wherein the third conductive portion has a width which is essentially equal to the width of the second conductive portion; and wherein the continuous trace has a fourth conductive portion, which is connected to a second end of the second portion, opposite its first end, the fourth conductive portion being wider than the second portion and providing capacitive loading of the antenna.

11. The multi-band antenna according to claim 10, wherein the fourth conductive portion is arranged in the second plane.

12. A multi-band antenna for use in a portable telecommunication apparatus, the antenna comprising a continuous trace of conductive material, the continuous trace having a first conductive portion arranged in a first plane and a second conductive portion arranged in a second plane, the second plane being different from the first plane, the first conductive portion having a feeding end to be connected to radio circuitry in the portable telecommunication apparatus, characterized in that the second conductive portion has a distinctly smaller width than the first conductive portion; and wherein the radio circuitry in the portable telecommunication apparatus is provided on a printed circuit board and wherein the continuous trace is provided at a vertical distance from the printed circuit board.

13. The multi-band antenna according to claim 12, wherein the vertical distance is of the order of 5–10 mm.

14. The multi-band antenna according to claim 12, further comprising an antenna connector for connecting the feeding end of the first conductive portion to the radio circuitry.

15. The multi-band antenna according to any of claims 1, 10, or 12, wherein the multi-band antenna is provided with a coating of plastic or rubber.

16. The multi-band antenna according to any of claims 1, 10, or 12, further comprising a dielectric member positioned between the first and second conductive portions (13, 15–16).

17. The multi-band antenna according to any of claims 1, 10, or 12, wherein the antenna is arranged to operate in at least three frequency bands.

18. The multi-band antenna according to claim 17, wherein the antenna is arranged to operate in at least three of the following: a first frequency band at about 900 MHz, a second frequency band at about 1800 MHz, a third frequency band at about 1900 MHz, a fourth frequency band at about 2100 MHz and a fifth frequency band at about 2400 MHz.

19. The multi-band antenna according to any of claims 1, 10, or 12, wherein there is a factor of 1:10 in difference in width between the second conductive portion and the first conductive portion.

20. A portable telecommunication apparatus for use in a wireless telecommunications system, comprising:

a multi-band antenna for the antenna comprising a continuous trace of conductive material, the continuous trace having a first conductive portion arranged in a first plane and a second conductive portion arranged in a second plane, the second plane being different from the first plane, the first conductive portion having a feeding end to be connected to radio circuitry in the portable telecommunication apparatus, characterized in that the second conductive portion has a distinctly smaller width than the first conductive portion;

wherein the first conductive portion has a rectilinear extension, whereas the second conductive portion is meander-shaped;

wherein the first plane is parallel to the second plane and wherein the continuous trace has a third conductive portion, which interconnects the first conductive portion with the second conductive portion and which is nonparallel to the first and second planes;

wherein the third conductive portion has a width which is essentially equal to the width of the second conductive portion; and wherein the third conductive portion is connected between a second end of the first conductive portion, opposite its feeding end, and a first end of the second conductive portion, and wherein the third conductive portion extends orthogonally between the first and second planes.

21. The portable telecommunication apparatus according to claim 20, wherein the portable telecommunication apparatus is a mobile telephone.

22. A portable telecommunication apparatus for use in a wireless telecommunications system, comprising:

a multi-band antenna for use in a portable telecommunication apparatus, the antenna comprising a continuous trace of conductive material, the continuous trace having a first conductive portion arranged in a first plane and a second conductive portion arranged in a second plane, the second plane being different from the first plane, the first conductive portion having a feeding end to be connected to radio circuitry in the portable telecommunication apparatus, characterized in that the second conductive portion has a distinctly smaller width than the first conductive portion;

wherein the first conductive portion has a rectilinear extension, whereas the second conductive portion is meander-shaped;

wherein the first plane is parallel to the second plane and wherein the continuous trace has a third conductive portion, which interconnects the first conductive portion with the second conductive portion and which is nonparallel to the first and second planes;

wherein the third conductive portion has a width which is essentially equal to the width of the second conductive portion; and wherein the continuous trace has a fourth conductive portion, which is connected to a second end of the second portion, opposite its first end, the fourth conductive portion being wider than the second portion and providing capacitive loading of the antenna.

23. The portable telecommunication apparatus according to claim 22, wherein the portable telecommunication apparatus is a mobile telephone.

24. A portable telecommunication apparatus for use in a wireless telecommunications system, comprising:

a multi-band antenna for use in a portable telecommunication apparatus, the antenna comprising a continuous trace of conductive material, the continuous trace having a first conductive portion arranged in a first plane and a second conductive portion arranged in a second plane, the second plane being different from the first plane, the first conductive portion having a feeding end to be connected to radio circuitry in the portable telecommunication apparatus, characterized in that the second conductive portion has a distinctly smaller width than the first conductive portion; and wherein the radio circuitry in the portable telecommunication apparatus is provided on a printed circuit board and wherein the continuous trace is provided at a vertical distance from the printed circuit board.

25. The portable telecommunication apparatus according to claim 24, wherein the portable telecommunication apparatus is a mobile telephone.

* * * * *